US008220968B2

(12) United States Patent
Hartmann, Jr. et al.

(10) Patent No.: US 8,220,968 B2
(45) Date of Patent: Jul. 17, 2012

(54) MOUNT ADJUSTABLE END CAP CLAMP LOCK FOR LIGHTING SYSTEMS

(75) Inventors: Richard Hartmann, Jr., Holland, MI (US); Michael K VanDuinen, West Olive, MI (US)

(73) Assignee: ITC Inc., Holland, MI (US)

( * ) Notice: Subject to any disclaimer, the term of this patent is extended or adjusted under 35 U.S.C. 154(b) by 422 days.

(21) Appl. No.: 12/629,261

(22) Filed: Dec. 2, 2009

(65) Prior Publication Data

US 2011/0128740 A1 Jun. 2, 2011

(51) Int. Cl.
*F21V 21/30* (2006.01)

(52) U.S. Cl. ..... 362/287; 362/285; 362/269; 362/270

(58) Field of Classification Search ..... 362/287, 362/270, 269, 217, 285
See application file for complete search history.

(56) References Cited

U.S. PATENT DOCUMENTS 4,816,969 A * 3/1989 Miller ..... 362/130
5,934,792 A 8/1999 Camarota
8,002,441 B2 * 8/2011 Barkdoll et al. ..... 362/287

* cited by examiner

*Primary Examiner* — Anabel Ton
(74) *Attorney, Agent, or Firm* — Miller, Canfield, Paddock and Stone, P.L.C.; Timothy J. Engling

(57) ABSTRACT

A mount adjustable end cap clamp lock used with an adjustable light source with one or both ends collared by a barrel-type end, which is rotatable within an end cap. The end cap has a mounting surface that works in conjunction with a fastener to secure the lighting system to an object. The clamp pad, which may extend beyond the mounting surface, is slidable relative to the end cap. When the fastener is tightened, the clamp pad slides relative to the end cap to press against the barrel to lock the barrel in angular position and secure the light source from rotating when the fastener is tightened to secure the lighting system to an object. The end cap in conjunction with the clamp pad serves a dual purpose.

12 Claims, 4 Drawing Sheets

MOUNT ADJUSTABLE END CAP CLAMP LOCK FOR LIGHTING SYSTEMS

FIELD OF THE DISCLOSURE

This disclosure relates to a display lighting system with an adjustable light source. More specifically, the lighting system includes a mount adjustable end cap clamp lock.

BACKGROUND

Lighting systems for displays often have undersurface mounting systems for light bars. A typical use would be a retail display counter. Ideally, these systems have light bars that can be adjusted for directing light where needed to illuminate the items in the display.

Lighting systems can be fastened to top, back or side wall surfaces, and may be included in aluminum light shields, which are ideal for mounting on front or rear surfaces inside a display case to give an aesthetic look and hidden illumination source.

Light bars are known as uni-directional light sources that can direct light. Some light bars include an aluminum extrusion housing with a clear polycarbonate lens. Often, these rigid light bars can rotate for directing light.

In order to focus a uni-directional light from an LED fixture, it is necessary to provide a means of rotating within an end cap relative to the support or object upon which the lighting system is mounted. Typically, a light bar is locked in position using a standard set-screws and a barrel type clamp. A split collar and screw clamp can also be used. Both of these common methods require a means to clamp the barrel separate from the means to mount the barrel.

While it is contemplated that rigid light bars are often used, flexible lighting systems are also available. U.S. Pat. No. 5,934,792 discloses a flexible lighting system including a flexible translucent rod (with an outer casing and an inner lighting core) disposed within outer casing, an attachment flange attached to the outer casing and an end cap for terminating an end of flexible lighting system. Preferably, the outer casing and the attachment flange are integrally formed to facilitate installation. The lighting core with a plurality of lighting elements is disposed within an axial aperture defined by the outer casing and contains a series of lighting elements.

SUMMARY

The present disclosure provides a lighting system including an adjustable light source with one or both barrel-type ends, which can be rotatable within an end cap. The end cap has a mounting surface that works in conjunction with a fastener to secure the lighting system to an object. The clamp pad, which extends more than the distance between the end of the light source and the mounting surface, is slidable in association with the end cap. When the fastener is tightened, the clamp pad slides within the end cap to press against the barrel-type end to lock the end in angular position and secure the light source from rotating when the fastener is tightened.

The mount adjustable end cap combines a clamp pad and one or more mounting screws or other fasteners by providing a small loose "break" pad adjacent to the barrel. This pad slightly extends more than the distance between the bottom of the barrel and the mounting surface of the end cap. Until pressure is applied, an end of the pad resiliently extends beyond the mounting surface. This provision mechanically locks the barrel in angular position when the preferred mounting screw is tightened and the pad presses against an end of the light source.

The method of locking the angular positioning of the light bar is unique, and the end cap serves a dual purpose that is not readily apparent to other designs.

BRIEF DESCRIPTION OF THE DRAWINGS

The above-mentioned and other features of this disclosure and the manner of obtaining them will become more apparent, and the disclosure itself will be best understood by reference to the following descriptions of devices taken in conjunction with the accompanying figures, which are given as non-limiting examples only, in which.

The exemplifications set out herein illustrate embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiments in different forms, the figures show, and herein described in detail, embodiments with the understanding that the present descriptions are to be considered exemplifications of the principles of the disclosure and are not intended to be exhaustive or to limit the disclosure to the details of construction and the arrangements of components set forth in the following description or illustrated in the figures.

Figure 1:
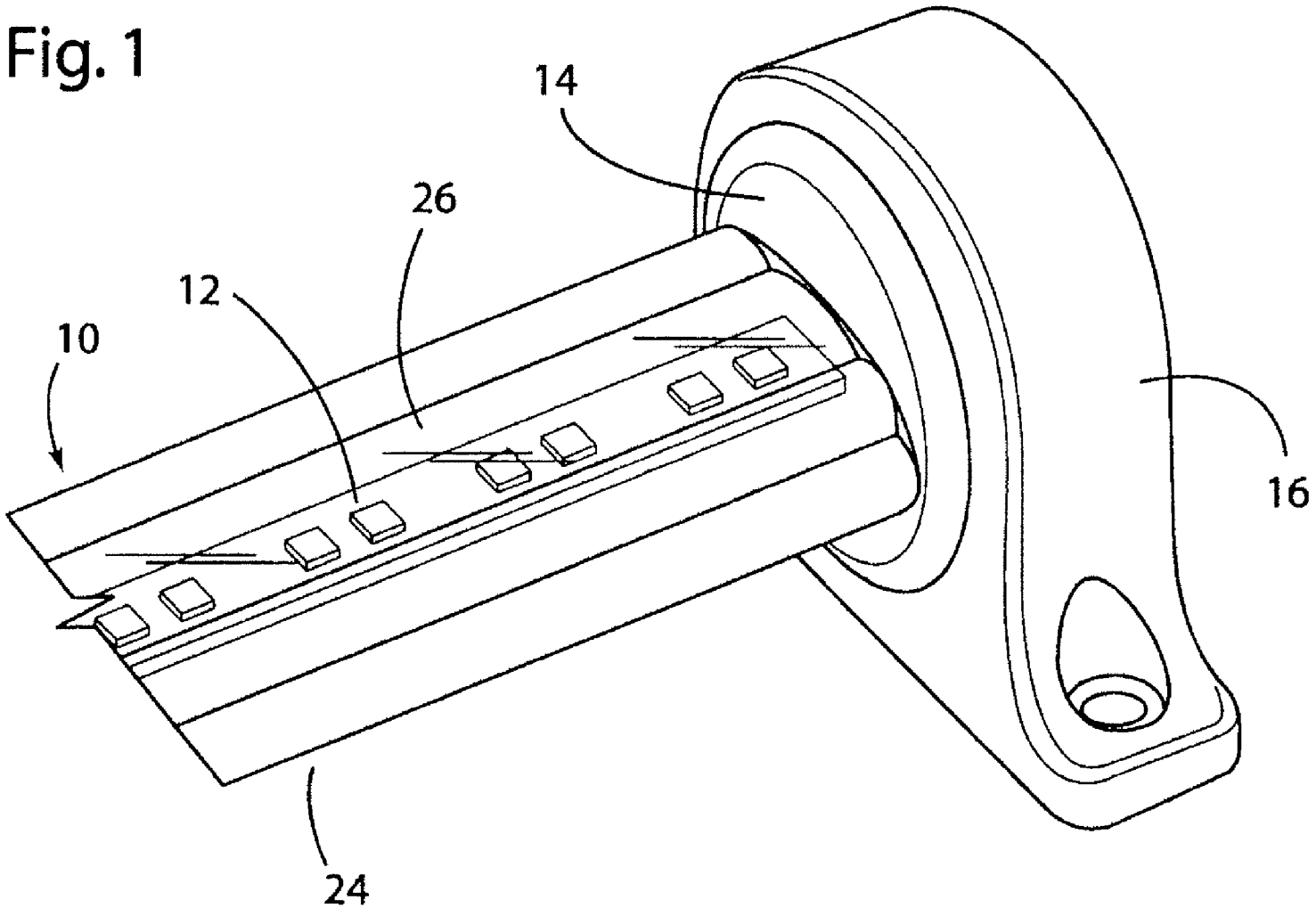
FIG. 1 illustrates a perspective view of an end of a lighting system with an end cap.
Figure 2:
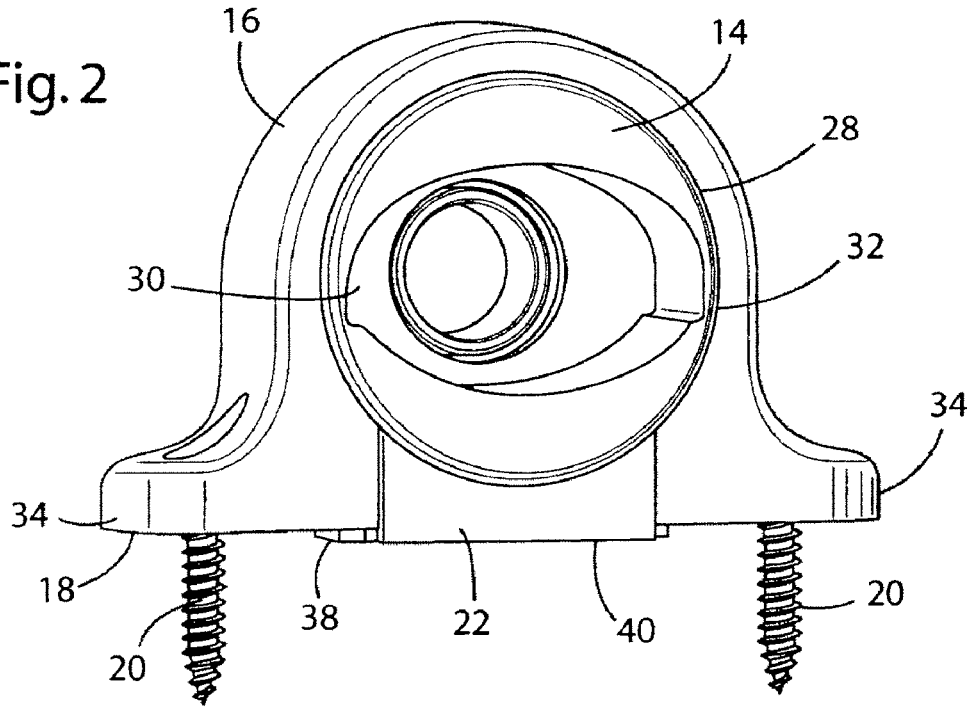
FIG. 2 illustrates a view of a mount adjustable end cap with a clamp pad that receives the light source.

As shown in FIG. 1, lighting system 10 includes an adjustable light source, such as a light bar 12, with an end preferably collared by barrel 14 that can rotate within an end cap 16. As shown in FIG. 2, the end cap 16 has a mounting surface 18 that works in conjunction with a fastener 20, which is shown as a preferred screw or two screws. A clamp pad 22 is a small loose pad that can slide relative to the end cap 16 when the end cap 16 is not fastened to an object with a mountable surface, such as a typical display counter. The "object" is not part of the invention, but rather indicates the environment in which the lighting system 10 can be set.

The light bar 12 can include an aluminum extruded housing 24 and a clear polycarbonate lens 26. The housing 24 can form an aspect of the barrel 14. The light bar 12 has one end collared by a barrel 14 that can rotate within an end cap 16, and in many instances both opposing ends of the light bar 12 will be collared by a barrel 14. The "barrel" can otherwise be integrated or part of an end of the light bar 12. The light bar 12 rotates, such as 90 degrees, to direct light where needed. A typical lens provides 120 degrees of illumination. This type of light bar 12 is intended to be available in multiple lengths.

With two opposing ends of the light bar 12 each collared by a barrel 14, each barrel 14 rotates within a respective end cap 16, with a clamp pad 22 slidable in association with each end cap 16.

The barrel 14 is typically cylindrical on a majority of the outside perimeter 28 with an inner depression 30 that corresponds to or complements the shape of the light bar 12. A rounded outside perimeter 28 of the barrel 14 allows rotation within an arcuate recess 32 of the end cap 16. A typical barrel can rotate 90 degrees for an undersurface mount while allowing light to shine away from the mounted surface, but the light bar 12 can rotate more or less as prudent for the design.

An end cap 16 that independently mounts to a surface can be "omega" shaped with a leg 34 extending from each side as part of the mounting surface 18 through which a fastener 20 can secure the end cap 16 to a mountable surface of an object. This is preferred for mounting on a flat mountable surface.

Figure 5:
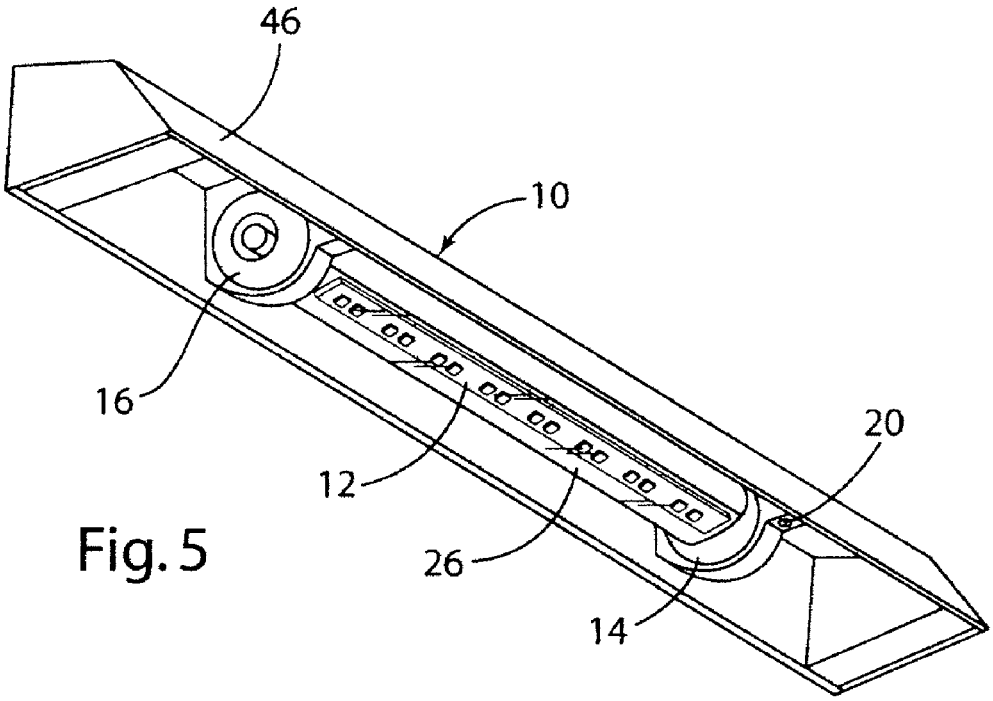
FIG. 5 illustrates a view of a perspective view of a display lighting system in a light shield.
Figure 6:
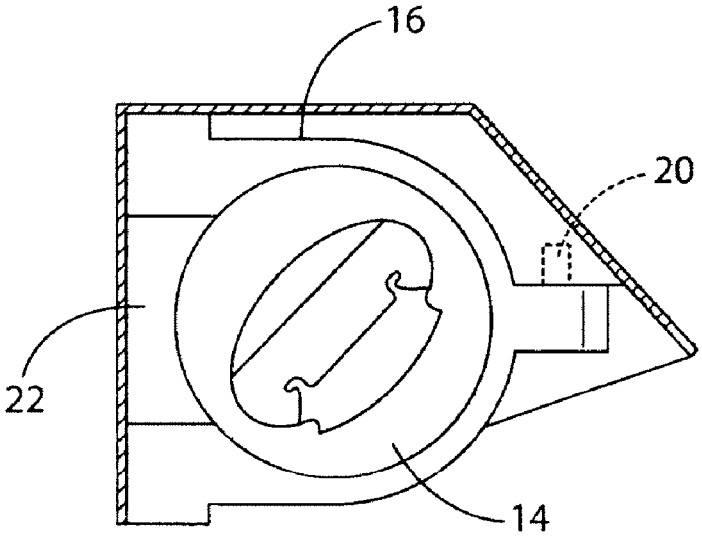
FIG. 6 illustrates a view of an end cap used with the display lighting system in a light shield.

In another embodiment shown in FIGS. 5 and 6, the shape of an end cap 16 can also correspond to the inner shape of a light shield 46. The end cap 16 is preferably a complementary shape to the inside of a light shield 46 so that the end cap 16 is secured against more than one wall of the inner light shield 46. In this embodiment, only one fastener 20, such as a screw, is required for each end cap 16. When the fastener 20 is a single screw that passes through the end cap 16, tightening of the screw holds the clamp pad 22 against the barrel 14 to secure the light bar 12 from rotation.

Figure 4:
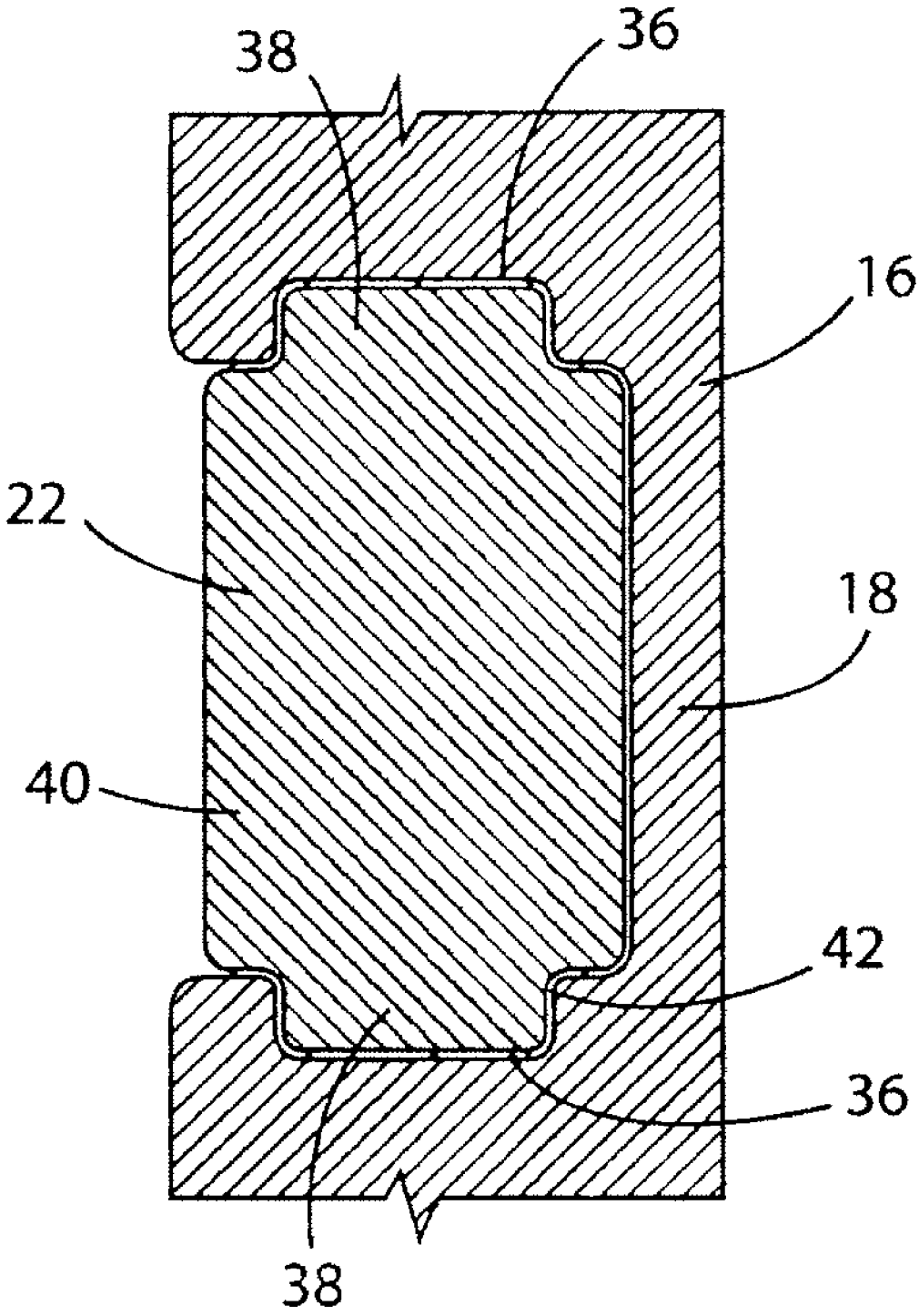
FIG. 4 illustrates a view of ridges of the clamp pad and notches in the end cap as viewed from the mounting surface.

The end cap 16 preferably has a notch 36 for a complementary ridge 38 of the clamp pad 22 as shown in FIG. 4. The clamp pad 22 can preferably slide when loose when the end cap 16 is not fastened to an object. The clamp pad 22 preferably slides perpendicular to the mounting surface 18. A surface 40 of the clamp pad 22 extends past the mounting surface 18 of the end cap 16 until the fastener 20 is tightened whereby the pressure of being tightened against an object pushes the clamp pad 22 toward the barrel 14 to secure and prevent angular movement of the barrel 14.

The portion of the clamp pad 22 that presses against the barrel 14 may have a shoulder or lip 42 that cannot pass through the notch 36 of the end cap 16 so that the clamp pad 22 does not completely slide out of the end cap 16. The shoulder or lip 42 is preferably on the end of the clamp pad 22 the presses into the barrel 14, opposite of the surface 40. During manufacturing, the clamp pad 22 with a shoulder or lip 42 would be installed into the notch 36 before the barrel 14 is inserted. An internal shoulder or lip 42 or a can track can keep the clamp pad 22 from completely sliding out of the end cap 16.

The light bar 12 can be fixed in one or typically two end caps 16 so light can be fixedly directed where needed until the fastener 20 is loosened allowing the clamp pad 22 to release off the barrel 14. The end cap 16 both secures the light bar 12 to an object and with the coupled clamp pad 22 secures the barrel 14, both when the fastener 20 is tightened. Thus, separate fasteners are not needed to secure the angular position of a barrel 14 from rotating when the fastener 20 is tightened.

Figure 3:
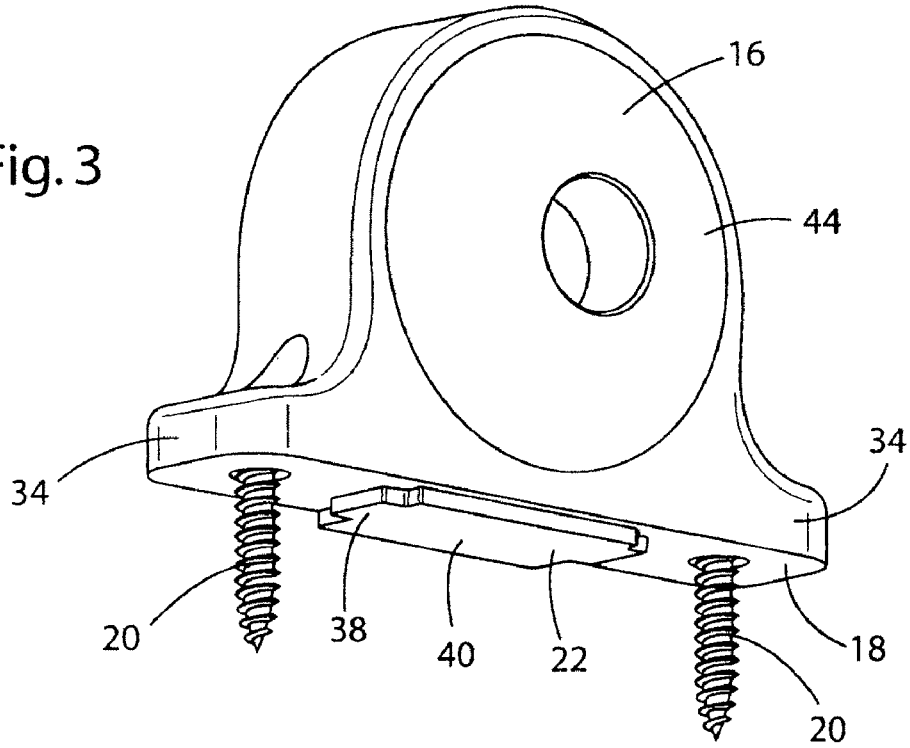
FIG. 3 illustrates a back view of a mount adjustable end cap with a clamp pad extending out the bottom between two fasteners.

As shown in FIG. 3, the end cap 16 preferably has a closed back side 44 so that the clamp pad 22 slides in notches 36 of the end cap 16 adjacent to an inner wall (not shown) of the end cap 16.

The clamp pad 22 can be a small loose "break" pad adjacent to the barrel. Pad 22 slightly extends more than the distance between the bottom of the barrel 14 and the mounting surface 18. As the fasteners 20 are tightened, the clamp pad 22 slides within the end cap 16 to press against the barrel 14. This provision locks the barrel 14 in angular position and secures the barrel 14 from rotating when the fastener 20 is tightened (securing the light source 12 to an object) so the end cap 16 in conjunction with the clamp pad 22 serves a dual purpose.

This disclosure has been described as having exemplary embodiments and is intended to cover any variations, uses, or adaptations using its general principles. It is envisioned that those skilled in the art may devise various modifications and equivalents without departing from the spirit and scope of the disclosure as recited in the following claims. Further, this disclosure is intended to cover such variations from the present disclosure as come within the known or customary practice within the art to which it pertains.

What is claimed is:

1. A lighting system comprising:

an adjustable light source with an end collared by a barrel, the barrel being rotatable within an end cap, the end cap having a mounting surface that works in conjunction with a fastener to secure the lighting system to an object; a clamp pad slidable in association with the end cap, the clamp pad extends more than the distance between the barrel and the mounting surface;

wherein as the fastener is tightened indirectly causing pressure on the clamp pad, the clamp pad slides relative to the end cap to press against the barrel to lock the barrel in angular position and secure the light source from rotating when the fastener is tightened.

2. The lighting system of claim 1 wherein the fastener is a single screw that passes through the end cap so when the screw is tightened, the clamp pad presses against the barrel when the end cap is fastened to said object when the mounting surface of the end cap is closer to said object than the distance that the clamp pad extends.

3. The lighting system of claim 1 wherein the end cap is a complementary shape to the inside of a light shield.

4. The lighting system of claim 1 wherein the end cap is omega-shaped with a leg extending from each side of the mounting surface with each fastener being a screw that passes through each leg of the end cap, so when the screws are tightened, the clamp pad presses against the barrel and the end cap is fastened to said object.

5. The lighting system of claim 1 wherein the light source has two opposing ends each collared by a barrel, each barrel being rotatable within respective end caps, and one clamp pad slidable within each end cap when the respective fastener is not tightened.

6. The lighting system of claim 1 wherein the end cap has a notch for a complementary ridge of the clamp pad to allow sliding of the clamp pad within the end cap.

7. The lighting system of claim 6 wherein the clamp pad the clamp pad has a shoulder that cannot pass through the notch of the end cap so the clamp pad does not completely slide out of the end cap.

8. In a lighting system with an adjustable light source, the light source being rotatable within an end cap, the improvement being the end cap having a mounting surface that works in conjunction with a fastener to secure the lighting system to an object and to secure the light source in angular position; a clamp pad slidable in the end cap perpendicular to the mounting surface, the clamp pad extendable beyond the mounting surface; the clamp pad adapted to press against a portion of the light source and secure the light source from rotating when the fastener tightens and indirectly causes pressure on the damp pad when the mounting surface moves closer to said object.

9. The end cap of claim 8 wherein the fastener is a single screw that passes through the end cap so when the screw is tightened, the clamp pad presses against the portion of the light source.

10. The end cap of claim 9 having a complementary shape to the inside of a light shield.

11. The end cap of claim 8 having a leg extending from each side of the mounting surface with each fastener being a screw that passes through each leg of the end cap, so when the screws are tightened, the clamp pad presses against the portion of the light source.

12. The end cap of claim 8 wherein the light source has two opposing ends each collared by a barrel, each barrel being rotatable within respective end caps, and one clamp pad slidable in association with each end cap when the respective fastener is not tightened.

* * * * *

UNITED STATES PATENT AND TRADEMARK OFFICE

CERTIFICATE OF CORRECTION

PATENT NO. : 8,220,968 B2
APPLICATION NO. : 12/629261
DATED : July 17, 2012
INVENTOR(S) : Richard Hartmann, Jr. and Michael K. VanDuinen It is certified that error appears in the above-identified patent and that said Letters Patent is hereby corrected as shown below:

In Claim 7, Column 4, lines 52 and 53, cancel the second instance of "the clamp pad".

In Claim 8, Column 4, line 66, "damp" should read --clamp--.

Signed and Sealed this
Eleventh Day of September, 2012

David J. Kappos

David J. Kappos
*Director of the United States Patent and Trademark Office*